United States Patent [19]

Cottrell et al.

[11] 3,947,365

[45] Mar. 30, 1976

[54] SOLID FIRE-EXTINGUISHING COMPOSITIONS

[75] Inventors: Arnold George Cottrell; John Malloy Paton, both of Runcorn, England

[73] Assignee: Imperial Chemical Industries Limited, London, England

[22] Filed: Sept. 14, 1973

[21] Appl. No.: 397,325

[30] Foreign Application Priority Data

Oct. 6, 1972 United Kingdom ..... 46136/72

[52] U.S. Cl. ..... 252/5; 252/7

[51] Int. Cl.[2] ..... A62D 1/00

[58] Field of Search ..... 252/2, 4, 5, 7

[56] References Cited

UNITED STATES PATENTS

| | | | |
|---|---|---|---|
| 2,901,427 | 8/1959 | Steppe | 252/5 |
| 3,536,620 | 10/1970 | Birchall | 252/2 X |
| 3,607,744 | 9/1971 | Cottrell | 252/2 X |
| 3,642,621 | 2/1972 | Hollows | 252/5 |
| 3,776,843 | 12/1973 | Cottrell et al. | 252/2 X |
| 3,822,206 | 7/1974 | Curran | 252/2 |

OTHER PUBLICATIONS

Condensed Chem. Dictionary, Reinhold Pub. Co., N.Y., N.Y., 5th Ed. 1956, p. 495.

*Primary Examiner*—Samuel Feinberg
*Assistant Examiner*—Peter A. Nelson
*Attorney, Agent, or Firm*—Cushman, Darby & Cushman

[57] ABSTRACT

A solid fire-extinguishing composition comprising a. carbamic powder containing a major proportion by weight of the compound $KC_2N_2H_3O_3$ and b. a non-hygroscopic powder having greater bulk density and median particle size than the said carbamic powder.

8 Claims, No Drawings

SOLID FIRE-EXTINGUISHING COMPOSITIONS

This invention relates to solid fire-extinguishing compositions.

In our UK Patent Specificatin No. 1,168,092 there is described and claimed, inter alia, a range of compositions containing as principal active fireextinguishant the compound $KC_2N_2H_3O_3$. These compositions are extremely powerful fire-fighting agents especially for extinguishing the fires of liquid fuels such as hydrocarbon fuels.

Fire-extinguishing compositions containing a major proportion of the compound $KC_2N_2H_3O_3$ are in use in practice against liquid fuel fires under the name 'carbamic powder' and will be referred to hereinafter by that name.

Carbamic powder has a distribution of particle sizes typically spreading over the range from 2$\mu$m to 200$\mu$m but we have observed that the smaller particles are the more effective in fire-extinguishing properties. However it is not a practical proposition to attempt to use only the smaller particles because such a fine powder is difficult to project to the region of the fire where the powder will be able to extinguish the flame. Furthermore, it is sometimes desirable to provide a fire-extinguishing composition of relatively high bulk density, thereby allowing a prescribed weight of powder to be charged to a given appliance.

We have now found that compositions having unimpaired fire-extinguishing properties may be made by the use of the smaller range of particles of the carbamic powder together with larger particles of another powder of higher bulk-density.

Thus according to the present invention there is provided a fire-extinguishing composition comprising a. carbamic powder containing a major proportion by weight of the compound $KC_2N_2H_3O_3$ and having a particle-size distribution such that at least 90% by weight of the carbamic powder is in the range from 0.1$\mu$m to 100$\mu$m; and b. a non-hygroscopic powder ('Powder B') having a particle-size distribution such that at least 90% by weight thereof is in the range from 50$\mu$m to 500$\mu$m;

the bulk-density and median particle size of Powder B being greater than that of the said carbamic powder and the proportion of Powder B being from 5 to 50% by weight of the total weight of Powder B and the said carbamic powder.

We define a non-hygroscopic powder as a powder which has a critical humidity of at least 80%, the term 'critical humidity' being defined as the lowest relative humidity of an atmosphere from which the powder will absorb water.

The powders preferred are those having a critical humidity of at least 90% and especially those having a critical humidity of at least 95% because the higher the critical humidity of the powder the more satisfactory is the composition for long-term storage.

Powder B may be itself an active fire-extinguishing powder or it may be an inert powder which merely acts as a diluent of a suitable particle size. Whether or not Powder B is active in extinguishing fires, we prefer that it is a powder which is inert chemically to the carbamic powder to minimise the risk of the superior fire-extinguishing power of the carbamic powder being lost. For example, as the carbamic powder is an alkaline-based powder, we prefer that Powder B should not be an acidic powder (for example mono ammonium phosphate or many other salts of strong acids with weak bases), or a powder containing ions which are likely to exchange with any of the ionic components of the carbamic powder.

Accordingly the non-hygroscopic powder may suitably be, for example a salt, filler, mineral ore or a fire-resistant organic compound, preferably a polymeric organic compound for example poly(vinyl chloride) or poly (vinylidene chloride).

Examples of powders having a suitably high bulk density desirable for Powder B are minerals containing silicon or aluminium, including silicas, silicates, complex silicates and silico aluminates or minerals containing heavy metals for example sulphates, phosphates, fluorides and carbonates of calcium or barium or hydroxides and oxides of the transition metals. Examples of especially preferred materials are alumina, silica, sand, limestone, kieselguhr, gypsum, fluorspar, zircon sand, brickdust and 'Perlite' or mixtures of any of these materials in powder form.

Examples of active fire-extinguishing salts preferred for Powder B are potassium salts including the chloride, sulphate and bicarbonate salts and mixtures thereof.

Powder B may be obtained in the desired particle size range by conventional methods for example grinding, milling, precipitation, crystallisation or granular polymerisation (where appropriate). It is clearly desirable, since the powder is required to be discharged after storage, that the powder be non-cohesive in character. Some powders, for example insoluble salts e.g. barium sulphate, when precipitated from solution are produced in a cohesive form and in the form of small particles which tend to be undesirable for the present invention. Thus we prefer to use an ore, mineral or salt ground and sieved to the desired particle size range.

For more effective compositions it is preferable that a. at least 90% of the carbamic powder is in the range 1$\mu$m to 75$\mu$m and especially in the range 10$\mu$m to 60$\mu$m and b. at least 90% of Powder B is in the range 50$\mu$m to 250$\mu$m and especially in the range 75$\mu$m to 180$\mu$m.

The compositions of the present invention are desired to have the maximum fire-extinguishing effect especially against Class B fires and for this purpose the proportion of carbamic powder in the total composition is preferably greater than 60% by weight and especially preferred are compositions containing at least 70% of carbamic powder.

The preparation of the compositions herein described may be carried out by conventional methods known for the preparation and selection of powder particles of desired sizes. Thus normal carbamic powder may be sieved and the smaller particles selected or the normal powder may be ground or milled more finely until at least 90% of the material is in the desired range of particle size. Alternatively a method of a preparation may be used which produces a fine particle size without grinding, for example a spray-drying or freeze-drying procedure. When Powder B has the desired particle size range the two powders may be mixed or blended together by any conventional method until intimately mixed.

Alternatively the compositions may be prepared by incorporating Powder B in the reaction mixture used for making the carbamic powder, conducting the chemical reaction in order to prepare the carbamic powder in the presence of Powder B and milling the product to produce a blend of the carbamic powder and Powder B of the desired particle size range.

The reaction may be carried out, for example, by heating the powder in open trays in an oven or in an agitated closed vessel containing water vapour. Alternatively a liquid medium may be present, which is preferably a solvent for one of the reactants, and the product filtered off after the reaction mixture has cooled. In this alternative process Powder B is preferably one which is unaffected by the reaction conditions and only minimally affected by the subsequent milling. Hard materials are accordingly especially suitable, for example silica, fluorspar, gypsum or zirconia.

The invention is illustrated but not limited by the following examples. ('Monnex' is a trade mark of Imperial Chemical Industries Limited).

EXAMPLE 1

A sample of Monnex carbamic powder fire-extinguishing agent was sieved and the fraction containing particles larger than 63$\mu$m was discarded.

A sample of washed high purity quartz sand (Redhill Grade 110 H) from British Industrial Sands was also sieved into various fractions having particles with diameters within the following ranges:

| | |
|---|---|
| 63 $\mu$m to 106$\mu$m | Range 1 |
| 106 $\mu$m to 150 $\mu$m | Range 2 |
| 150 $\mu$m to 250 $\mu$m | Range 3 |

A blend was prepared containing

75% of the sieved Monnex containing particles smaller than 63$\mu$m

5% sand of Range 1

15% sand of Range 2

5% sand of Range 3

The bulk density of the resulting sand/carbamic powder blend was observed to be 25% greater than that of normal carbamic powder alone.

The fire-extinguishing power of the blend was tested on a 200 sq. ft. fire (U.L. Specification No. 711) and shown to have an equivalent extinction power to the standard grade of carbamic powder described in T. S. Note No. 2283 May 1968 issued by Imperial Chemical Industries Limited.

The discharge characteristics of the blend were compared with those of Monnex carbamic powder and, by way of comparison, with a sample of carbamic powder sieved as described above but without admixture of sand. Each of the powders was discharged from a 10 lb extinguisher pressurised to 175 psig in a horizontal direction at about 2 feet from the ground.

For the Monnex and for the blend of this example about six seconds after discharge the cone of powder had a diameter of 1½ ft. at a distance of 6 feet from the extinguisher and all the way from 8 feet up to 30 feet from the extinguisher a heavy cloud of powder covered the ground area to a height of 6 feet from the ground.

For the sieved carbamic powder the discharge was observed to be poor; the cone was much wider at a distance of 6 feet from the extinguisher and at a distance of 8 feet from the extinguisher the cloud started to thin out and disperse, very little powder reaching a distance of 30 feet from the extinguisher.

EXAMPLE 2

The same fractions of sand were used as for Example 1 and blends were made with a sample of Monnex carbamic powder ground in a ball mill until at least 90% of the particles had diameters less than 75$\mu$m.

Blends were prepared having the following composition

| | |
|---|---|
| 75% by weight carbamic powder | |
| 5% by weight Range 1 sand | |
| 10% by weight Range 2 sand | as specified |
| 5% by weight Range 3 sand | in Example 1. |

The bulk density was observed to be 20% greater than that of normal carbamic powder and the fire-extinguishing properties were observed to be very similar to those of Monnex carbamic powder.

EXAMPLE 3

A mixture of solids was prepared containing 25 parts of fluorspar of particle size 63–250$\mu$m.

74 parts of potassium bicarbonate and 28 parts of urea.

This was placed in open trays and heated in an oven for 3 hours under an atmosphere containing 30% by volume of steam and 70% of nitrogen. The mixture was cooled and reduced in size by ball-milling until the bulk density was 0.85.

Analysis of the composition thus produced showed it to contain

29% calcium fluoride and

46% of the compound $KC_2N_2H_3O_3$ the active fire-extinguishing agent.

Sieve analysis showed there to be 30% by weight in the size range 63–250$\mu$m and the chemical analysis of this fraction showed it to be almost wholly composed of calcium fluoride.

A similar reaction performed with the same proportions but with sand replacing the fluorspar yielded a composition containing 29.6% sand and 57% of $KC_2N_2H_3O_3$ with a bulk density of 0.95.

Both compositions were suitable for use as fire-extinguishants.

EXAMPLE 4

A dry powder mixture was prepared containing 25 parts of zircon sand having a particle size range 63$\mu$m to 250$\mu$m 47 parts of potassium bicarbonate 31 parts of urea The mixture was suspended, in a flask fitted with a stirrer, in 250 ml of bis-(2-methoxyethyl)ether. The suspension was heated and maintained at a temperature between 95° and 115°C for 1.5 hours. The resulting mixture was cooled to room temperature, filtered, washed with methanol and dried at 50°C.

The dried cake was then milled to reduce the particle size of the composition until the bulk density was 0.90.

The composition thus obtained, consisting predominantly of zircon sand and $KC_2N_2H_3O_3$, was suitable for use as a fire-extinguishant.

What we claim is:

1. A fire-extinguishing composition comprising a. carbamic powder containing a major proportion by weight of the compound $KC_2N_2H_3O_3$ and having a particle size distribution such that at least 90% by weight of the carbamic powder is in the range from 0.1μm to 100μm and b. a Powder B which is a non-hygroscopic powder having a particle-size distribution such that at least 90% by weight thereof is in the range from 50μm to 500μm, the bulk density and median particle size of Powder B being greater than that of the said carbamic powder and the proportion of Powder B being from 5 to 50% by weight of the total weight of Powder B and the said carbamic powder.

2. A composition according to claim 1 wherein a. at least 90% by weight of the carbamic powder is in the range 1μm to 75μm and b. at least 90% of Powder B is in the range 50μm to 250μm.

3. A composition according to claim 2 wherein at least 90% by weight of the carbamic powder is in the range 10μm to 60μm.

4. A composition according to claim 1 wherein the critical humidity of Powder B is at least 90%.

5. A composition according to claim 1 wherein Powder B is a sand.

6. A composition according to claim 1 wherein Powder B is fluorspar.

7. A method of preparing a composition according to claim 1 which comprises mixing Powder B with preformed carbamic powder.

8. A method of preparing a composition according to claim 1 wherein Powder B is incorporated in the reaction mixture used for making the carbamic powder.

* * * * *